US005110065A

United States Patent [19]

Cawelti et al.

[11] Patent Number: 5,110,065

[45] Date of Patent: May 5, 1992

[54] BOBBIN WINDING CONTROL

[75] Inventors: Donald G. Cawelti; Bryan F. Berlin, both of Tucson, Ariz.; John T. Kenna, Thousand Oaks, Calif.

[73] Assignee: Hughes Aircraft Comapny, Los Angeles, Calif.

[21] Appl. No.: 669,251

[22] Filed: Mar. 14, 1991

[51] Int. Cl.[5] ..... B65H 54/28

[52] U.S. Cl. ..... 242/158 R; 242/18 R; 242/25 R; 242/47

[58] Field of Search ..... 242/158 R, 158 B, 158 F, 242/158.2, 158.4 R, 158.4 A, 25 R, 47, 18 G

[56] References Cited

U.S. PATENT DOCUMENTS

| | | | |
|---|---|---|---|
| 3,319,070 | 5/1967 | Schneider | 242/158 R X |
| 4,570,875 | 2/1986 | Buluschek | 242/158 R |
| 4,655,410 | 4/1987 | Ruffin et al. | 242/158 R |
| 4,838,500 | 6/1989 | Graham | 242/158 R |
| 4,920,738 | 5/1990 | White et al. | 242/158 R X |
| 4,928,904 | 5/1990 | Watts | 242/158 R |

*Primary Examiner*—Stanley N. Gilreath
*Attorney, Agent, or Firm*—R. M. Heald; C. D. Brown; W. K. Denson-Low

[57] ABSTRACT

A laser beam (12) scans a filament (8) being wound onto a bobbin (42) sensing the winding angle of attack $\beta$ and on determining a variance of the angle from a predetermined desired angle generating a signal in a filament position monitor and control (38) for energizing a bobbin carriage drive (40) to correct the winding angle $\beta$. Additionally, the laser beam (12) can scan filament (18) before it becomes the last winding on the bobbin (42) and on a climb-back or gap occurring the filament position monitor and control (38) reverses the spindle drive (41) to remove the climb-back or gap and then reassumes normal carriage drive (40) and spindle drive (41).

4 Claims, 1 Drawing Sheet

FIG. 1a.
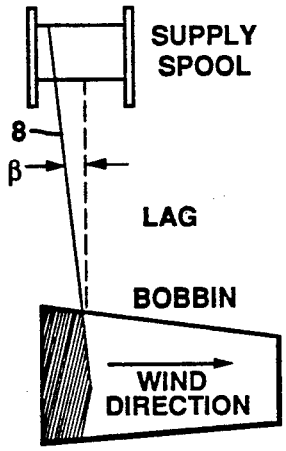
FIG. 1b.
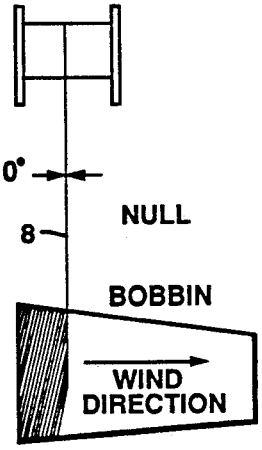
FIG. 1c.
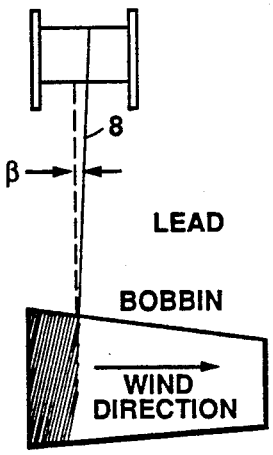
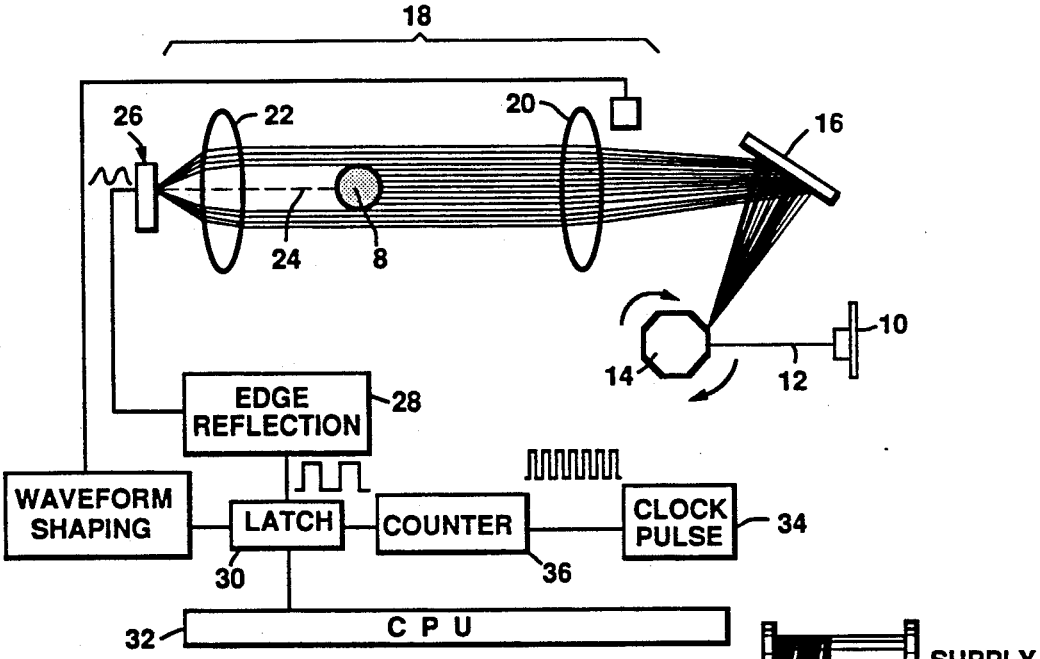
FIG. 2a.
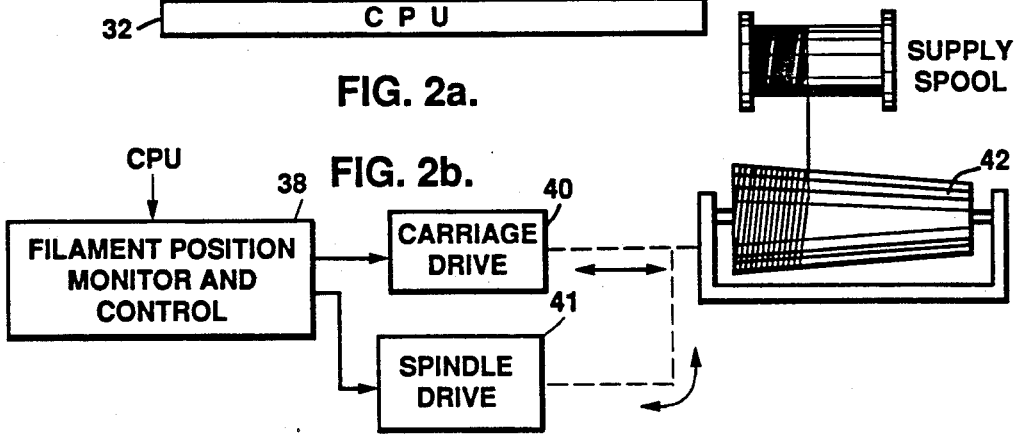
FIG. 2b.

BOBBIN WINDING CONTROL

BACKGROUND OF THE INVENTION

1. Field of the Invention

The present invention refers generally to the winding of a filament onto a bobbin or canister, and, more particularly, to controlling the winding of such a filament to a high degree of accuracy without physically contacting the filament for this purpose.

2. Description of Related Art

There are many situations in which a filament is wound onto a bobbin or canister in an even and consistent winding and where inconsistencies such as gapping or climb-back are cause for rejection. An example is when an optical fiber or metal wire filament is wound onto a canister for subsequent dispensing during flight of a vehicle to maintain a data link with launch site equipment. When used for this purpose, an improperly wound bobbin or canister may produce stress in the filament during dispense that can cause it to break upon use, or, if not that, stress to the point that transmission of data will be less efficient.

Known current systems for controlling winding precision rely upon open loop control and do not monitor the actual filament position as it is applied to a bobbin or after it has already been laid down on the bobbin. In accordance with these known techniques, the filament is wound by traversing the canister to pre-programmed locations and it is merely assumed or expected that the filament will fall into proper position. It is known that variations in the angle that the filament makes on approaching the canister during winding, the filament diameter, as well as tension and surface finish of the filament may easily result in the filament being improperly placed on the bobbin and ending up with a defective wind which must be removed or rewound. All of this increases possibility of filament stress, contamination and increased winding time. Where such a bobbin is to be used for data link on a missile, for example, if the filament is caused to break because of defective winding, the missile may be unable to locate its target.

SUMMARY OF THE INVENTION

It is a primary aim and object of the present invention to provide method and apparatus for precisely and continuously sensing the position of a filament being wound onto a bobbin and thus the angle of attack of the filament without physical contact being made with the filament for this purpose.

Another object of the invention is the provision of such a method and apparatus in which closed loop control enables effecting winding angle change to a predetermined desired norm.

Yet another object is the provision of a method and apparatus according to the previous objects in which the portion of the filament is used to detect undesirable gaps or climb-backs which are then removed and winding continued, all in closed-loop manner.

Apparatus for practicing the method of this invention includes a laser micrometer which scans the region through which a filament passes on its way to being wound onto a bobbin. The micrometer precisely senses cable filament location providing a continuous readout of the distance of the filament from a fixed point to the filament edge. These readings provide the actual angle of the filament relative to the bobbin surface on which the filament is being wound.

On comparing the actual measured angle with a predetermined desired angle, an error signal is generated which is used to correct the positioning of the bobbin in the direction to remove the error. In this way, by maintaining the proper filament to bobbin angle, proper placement of the filament in a winding layer is achieved. When a bobbin is wound for dispensing filament from a non-rotating reel, it is especially desirable to control the winding pattern very accurately in order to reduce gapping or climb-back which can make a defective winding. Accordingly, in the practice of the present invention, the filament sensor is located immediately adjacent the filament laydown point on the bobbin with deflection of the cable being applied indicating the location of the previously wound filament. Analysis of this data enables locating any point where the filament may gap or climb-back over itself to be determined and prevent it. Moreover, analysis of this data enables locating that point where required crossovers occur and controlling the location of successive crossovers and step-backs.

Detection of faults such as gaps and climb-backs is accomplished by continuously comparing actual filament position with the desired filament position. On noting a fault(e.g., gap, climb-back), winding is stopped and reversed to remove the fault, after which normal winding is resumed.

DESCRIPTION OF THE DRAWING

In the accompanying drawing:

FIGS. 1A, 1B and 1C depict different filament angles of attack in winding a bobbin;

FIG. 2*a* is a function block schematic of apparatus for determining filament winding angle of attack; and FIG. 2*b* is a further function block schematic of apparatus for detecting and correcting winding faults.

DESCRIPTION OF A PREFERRED EMBODIMENT

Winding of filaments and especially optical fiber filaments requires skilled operators with very accurate winding equipment. This is especially true where the total length of fiber to be wound is very long, e.g. 10 km. Also, since optical fibers are continuously decreasing in diameter (e.g., 180 microns), it is becoming correspondingly more difficult to detect winding faults. Typically, an operator will wind 100 or so turns on a bobbin, then stop the winding operation and inspect for fiber conformity, namely, to see if there are any gaps, drifting crossovers and for general appearance. Having to repeat this, say, for each 100 turn layer portion is detrimental to winding time efficiency where, for example, each layer may include 1500 turns. It is desirable, therefore, to be able to reduce the difficulties associated with manual winding operations and this is provided by the present invention in eliminating or substantially reducing inline manual inspection and continuous visual monitoring of laydown of the filament for fault detection.

A bobbin to be used as a data link is typically tapered and the filament is dispensed without rotation of the bobbin. In winding such a tapered filament pack, the winding usually begins at the large end of the bobbin with the angle $\beta$ between the incoming filament 8 to the axis of the bobbin being less than 90 degrees which is shown in FIG. 1A and referred to as a "lag". If this lag angle is not properly set up initially, the machine could be winding with a "null" or "lead" angle as shown in FIGS. 1B and 1C, in which case, there would be risk of the filament jumping from its proper groove to an adjacent groove. In the past there has been no fully adequate way of checking the attack angle during pack winding other than having the operator repeatedly stop winding and make measurements to insure that the prescribed angle has been maintained.

Turning now to FIGS. 2*a* and 2*b*, there is shown in function block diagram form an overall schematic of the apparatus of this invention for accomplishing positional identification of a filament during a winding operation. A semiconductor laser 10 generates a laser beam 12 directed toward and reflected off an octagonal mirror 14. The mirror rotates at a predetermined angular rate causing the laser beam 12 to be swept across a reflector 16 and similarly to be swept transversely across an optical system 18 consisting of a collimator lens 20 and a receiver lens 22, the optical axis 24 of which is centered on the reflector 16 and a light sensitive element 26 that generates a signal responsive to laser beam impingement.

As the laser sweeps across the region between the collimator and receiver lenses 20 and 22 within which the filament 8 is located, there is generated a signal of timed relation by an edge detection circuit 28 responsive to interruption of the laser beam by the filament leading edge. Accordingly, the signal available at the output of circuit 28 is representative of the actual winding lag angle $\beta$ for the filament. By establishing a known reference signal for a fixed lag angle (i.e., the lag angle desired), this enables continuous monitoring of the filament lag angle. More particularly, the square wave output from circuit 28 sets a latch 30 the output of which is fed into a central processor 32 where the position of the filament edge is calculated. A clock pulse generator 34 energizes a counter 36 which resets the latch after a predetermined count has accumulated to initiate a new filament detection cycle.

On a filament angular winding position error being determined by the filament position monitor and control 38, the carriage drive 40 is driven to reposition bobbin 42 along its axis in the proper direction to modify the angle of attack of the filament 8 being wound and drive the error to zero. In this way there is provided a closed-loop system continuously maintaining the lag angle within required tolerances.

For the ensuing description of those aspects of the invention particularly directed to determining winding faults and correcting them, reference is still made to FIGS. 2*a* and 2*b* and the function block circuit schematic depicted there. The position of the filament is detected as before and sent from the CPU 32 to the filament position monitor and control 38 where a further error signal is obtained on comparing the instantaneous position of the filament which becomes the last wound fiber winding with a prestored desired value. If a climb-back or gap is determined, the carriage drive 40 and spindle drive 41 are stopped, the spindle drive is reversed, and filament is removed from the bobbin back to some convenient point prior to the winding defect detected. Now, normal winding may be resumed.

Although the automatic filament angle of attack control previously discussed can be used separately from the winding defect detection and defect removal just described, it would be advantageous in most situations to utilize both at the same time. In fact, it may be preferable that both be simultaneously employed since there is substantial possibility of interactive effect so that corrective action taken in one system may require further correction in the other.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A method of determining winding errors including gapping and climb-back as well as improper attack angle of a filament being wound onto a bobbin, comprising the steps of:

periodically sweeping a laser beam across a region within which the filament approaching the bobbin is located;

detecting the interruption of the laser beam by the filament and continuously generating a signal corresponding thereto;

establishing a reference signal corresponding to a predetermined filament angle of attack;

comparing the predetermined angle of attack reference signal with the continuously generated signal to provide an error signal representative of the difference between said compared signal;

establishing a further reference signal corresponding to an acceptably positioned filament approaching the bobbin;

comparing the continuously generated signal with the further reference signal to provide an error differential signal;

reversing bobbin rotation responsive to the error differential signal; and resuming bobbin winding rotation responsive to cessation of the error differential signal.

2. A method as in claim 1, in which there is further provided the step of moving the bobbin to change the filament angle of attack in such direction and amount as to null the error signal.

3. A method of correcting winding errors (e.g., gapping, climb-back) in rotating and axially advancing bobbin layer wound with a filament, comprising the steps of:

scanning a region within which the filament approaching the bobbin is located;

continuously detecting the interruption of the laser beam by the filament winding approaching the bobbin and generating a continuous signal corresponding thereto;

storing a signal corresponding to an acceptably positioned filament approaching the bobbin;

comparing the continuously generated signal with the stored signal and producing an error difference signal;

reversing bobbin rotation responsive to presence of the error signal; and resuming bobbin winding rotation responsive to cessation of the error signal.

4. A method as in claim 3, in which reversing includes, in the order recited, stopping bobbin rotation and axial advancement, reversing rotation and axial advancement direction until the error signal ceases.

* * * * *